US005119517A

United States Patent [19]

Chang

[11] Patent Number: 5,119,517

[45] Date of Patent: Jun. 9, 1992

[54] TOILET SANITIZING DEVICE

[76] Inventor: Hsu S. Chang, 6, Alley 3, Lane 181, Min Tsu Rd., Tung Wan Tsun, Yung Kang Hsiang, Tainan Hsien, Taiwan

[21] Appl. No.: 565,060

[22] Filed: Aug. 10, 1990

[51] Int. Cl.[5] ..... A47K 13/30

[52] U.S. Cl. ..... 4/233

[58] Field of Search ..... 4/233

[56] References Cited

U.S. PATENT DOCUMENTS

| | | | |
|---|---|---|---|
| 1,877,689 | 9/1932 | Peterson | 4/233 |
| 2,592,167 | 4/1952 | Managhan | 4/233 |
| 4,853,982 | 8/1989 | Martinval | 4/233 |
| 4,924,532 | 5/1990 | Pennestri | 4/233 |
| 5,022,097 | 6/1991 | Pusic | 4/233 |

FOREIGN PATENT DOCUMENTS

| | | | |
|---|---|---|---|
| 2907754 | 9/1980 | Fed. Rep. of Germany | 4/233 |

*Primary Examiner*—Charles E. Phillips

*Attorney, Agent, or Firm*—Morton J. Rosenberg; David I. Klein

[57] ABSTRACT

A toilet sanitizing device is provided, wherein the toilet seat can be pre-heated before use and cleaned with liquid cleaner after use to avoid disease infection. The seat is raised by a servomotor into a position for cleaning responsive to signals from a pedal switch and an infrared detector.

2 Claims, 5 Drawing Sheets

TOILET SANITIZING DEVICE

BACKGROUND OF THE INVENTION

The toilet is a household necessity to everyone, and therefore, every family, hotel, and public place have toilets for people to use. Toilets located in the home normally are used only by family members, and will not pose any disease infection problem. Those in public places are exposed to the unknown potential infections by hundreds of users.

Toilet seat covers have not been accepted into individual family houses and have not proved cost effective in hotels and public facility use. Thus, there is a need for a cost effective toilet sanitizing device which minimizes the possibilities of getting infection.

SUMMARY OF THE INVENTION

It is the primary object of the present invention to provide a toilet sanitizing device which can clean the seat after each use.

It is another object of the present invention to provide a toilet sanitizing device which preheats the seat cover.

It is still another object of the present invention to provide a toilet sanitizing device which minimizes the possibilty of disease infection.

It is a further object of the present invention to provide a toilet sanitizing device which is easy to operate.

It is another further object of the present invention to provide a toilet sanitizing device which is inexpensive to produce.

DETAILED DESCRIPTION OF THE PREFERRED EMBODIMENT

Figure 1:
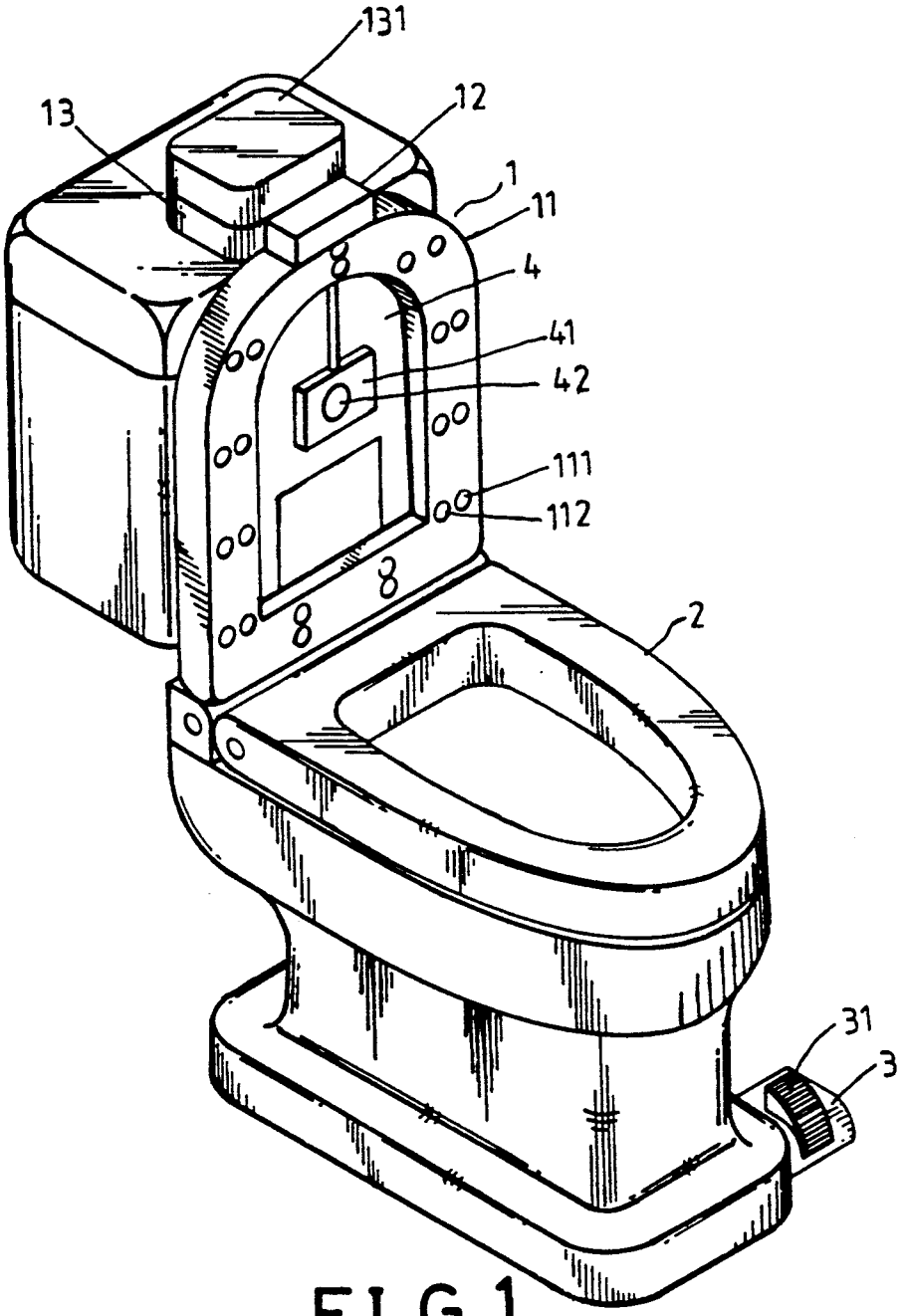
FIG. 1 is a perspective view of the present invention.

Referring to the drawings, and in particular to FIG. 1, the device comprises a cover 1, a toilet seat 2 and a pedal switch 3. The cover 1 is shaped like an ordinary toilet cover and has a bulge portion 11 having several hot air outlets 111 and water ejection holes 112. The bulge portion 11 is connected with a circuit box 12 and a cleaner box 13.

Figure 2:
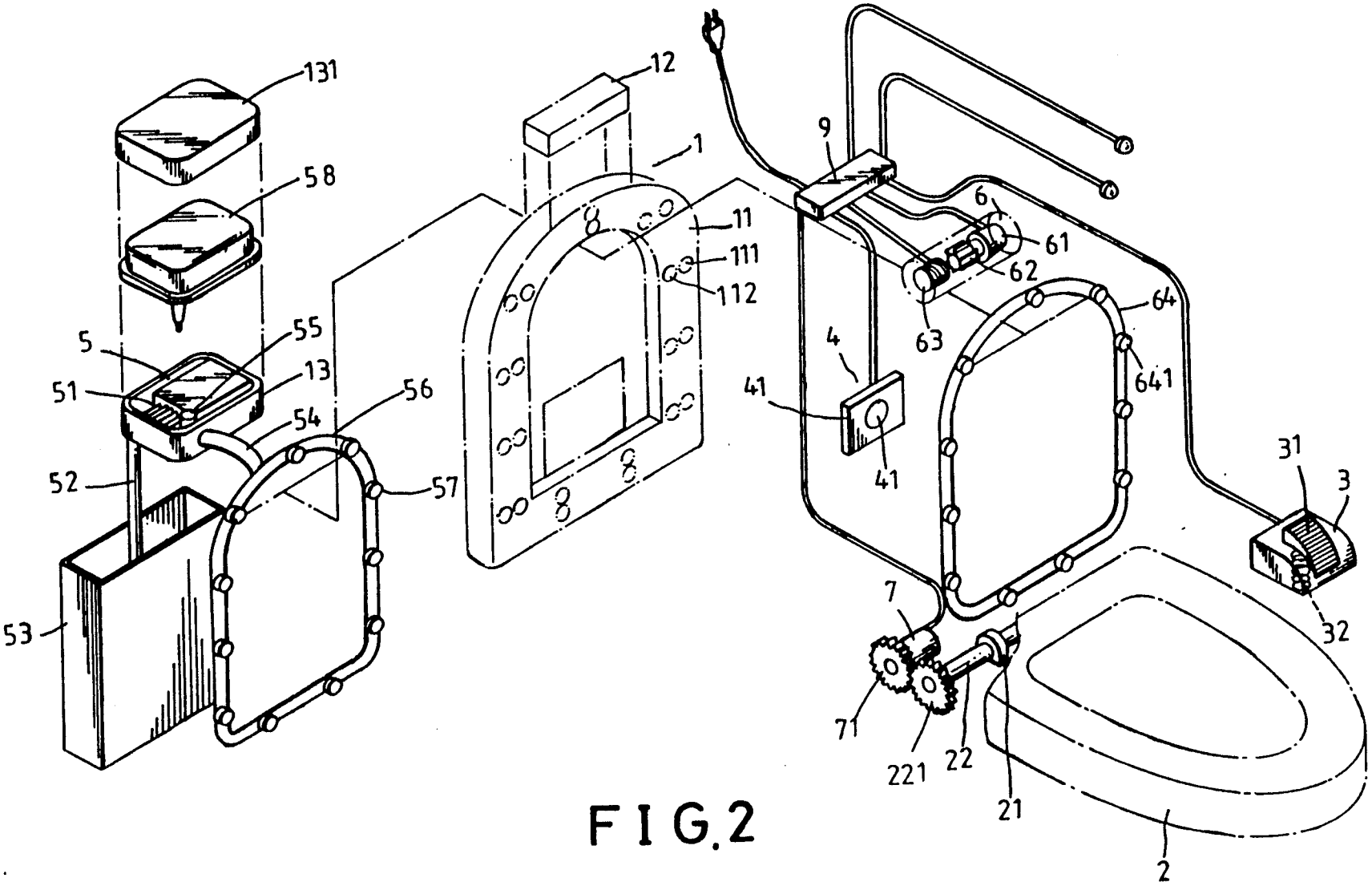
FIG. 2 is a fragmentary view of the present invention.

The toilet seat 2, as shown in FIG. 2, has two support fixtures 21, an axle 22 pivotally coupled to the support fixtures 21, and a gear 221 connected at one end of the axle 22. The pedal switch 3 has a pedal 31, a spring 32 having one end connected with the pedal 31 and the other end connected with a switch 33. A detector 4 disposed on cover 1 has a sensor 42 which uses infrared rays to determine if the seat 2 is occupied, and is covered in a case 41. A water pump 5 is installed in the bottom of the cleaner box 13 and has a blade 51 at its front end connected with both the water inlet pipe 52 and the outlet pipe 54 to pump water for cleaning the seat 2. The water inlet pipe 52 goes into a water barrel 53 which is located in the toilet tank and is lower than the water line of the tank for supplying water to be mixed with a cleaning solution. The water outlet pipe 54 has a universal joint at its front end that is connected to the cleaning liquid outlet pipe 55. The cleaning liquid is provided in bag 58 disposed above the cleaner box 13, having an outlet coupled to the outlet pipe 55, and has a cover 131 to contain it. The other end of the universal joint is connected to a loop pipe 56. Loop pipe 56 has a plurality of nozzles 57 facing the water ejection holes 112 of cover 1.

Figure 3:
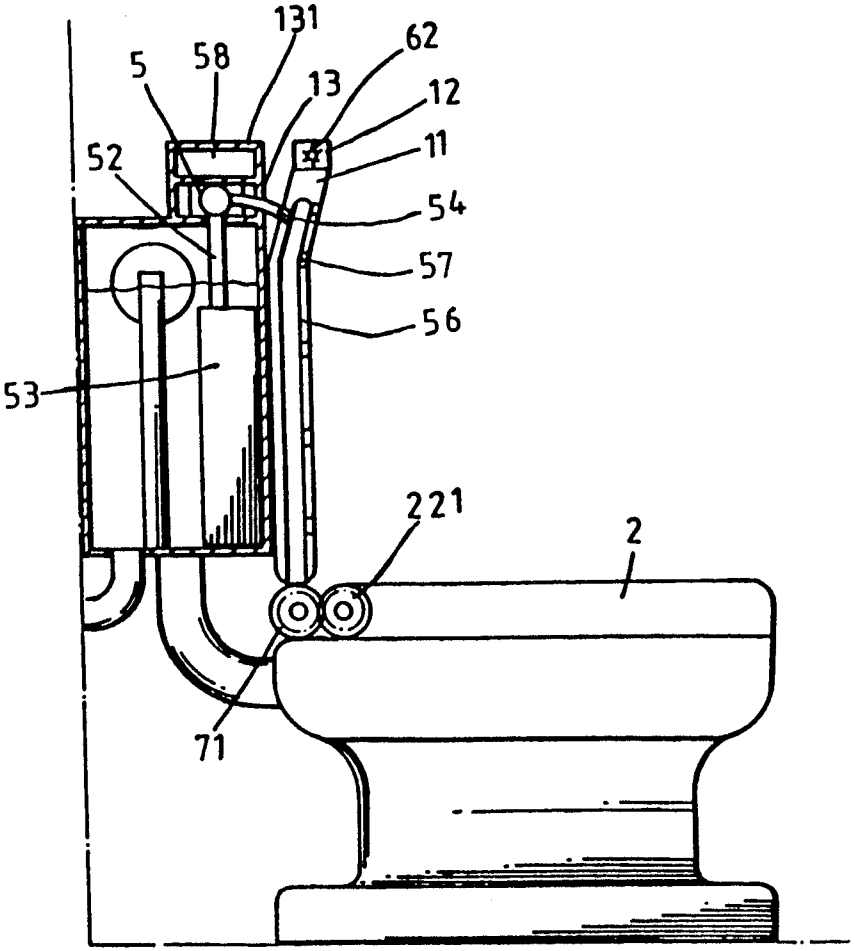
FIG. 3 is a side partial cross-sectional view of the present invention.
Figure 6:
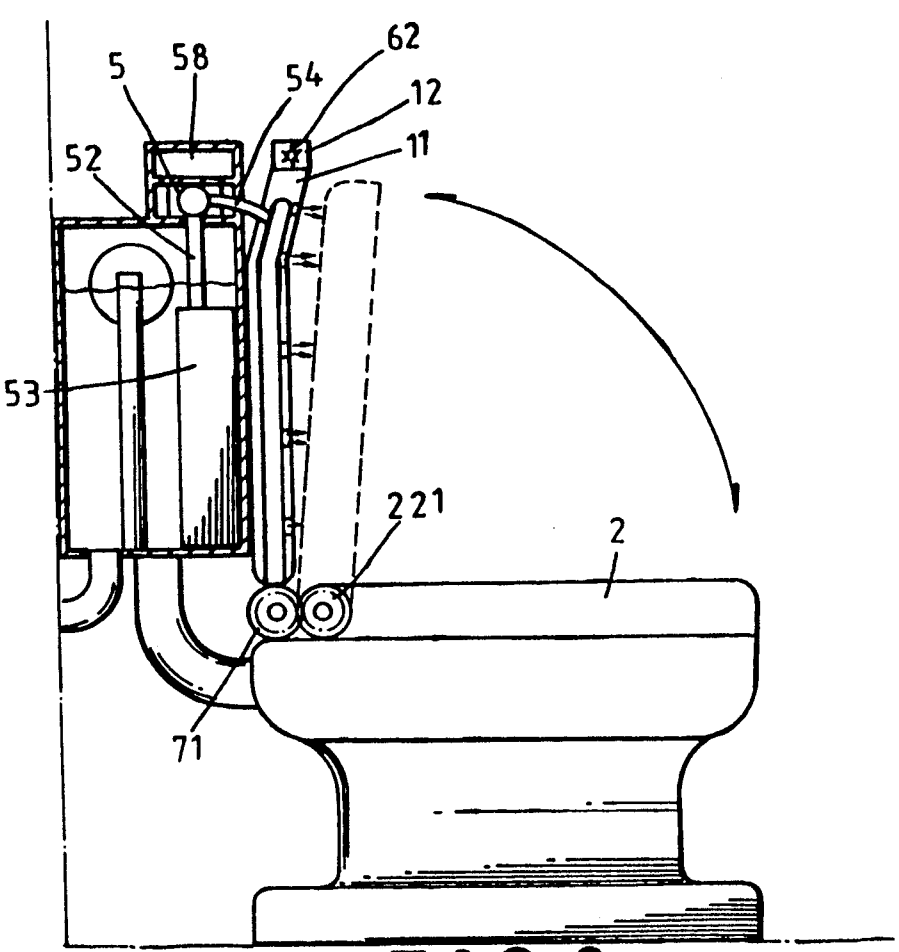
FIG. 6 is a further side partial cross-sectional view of the present invention.
Figure 5:
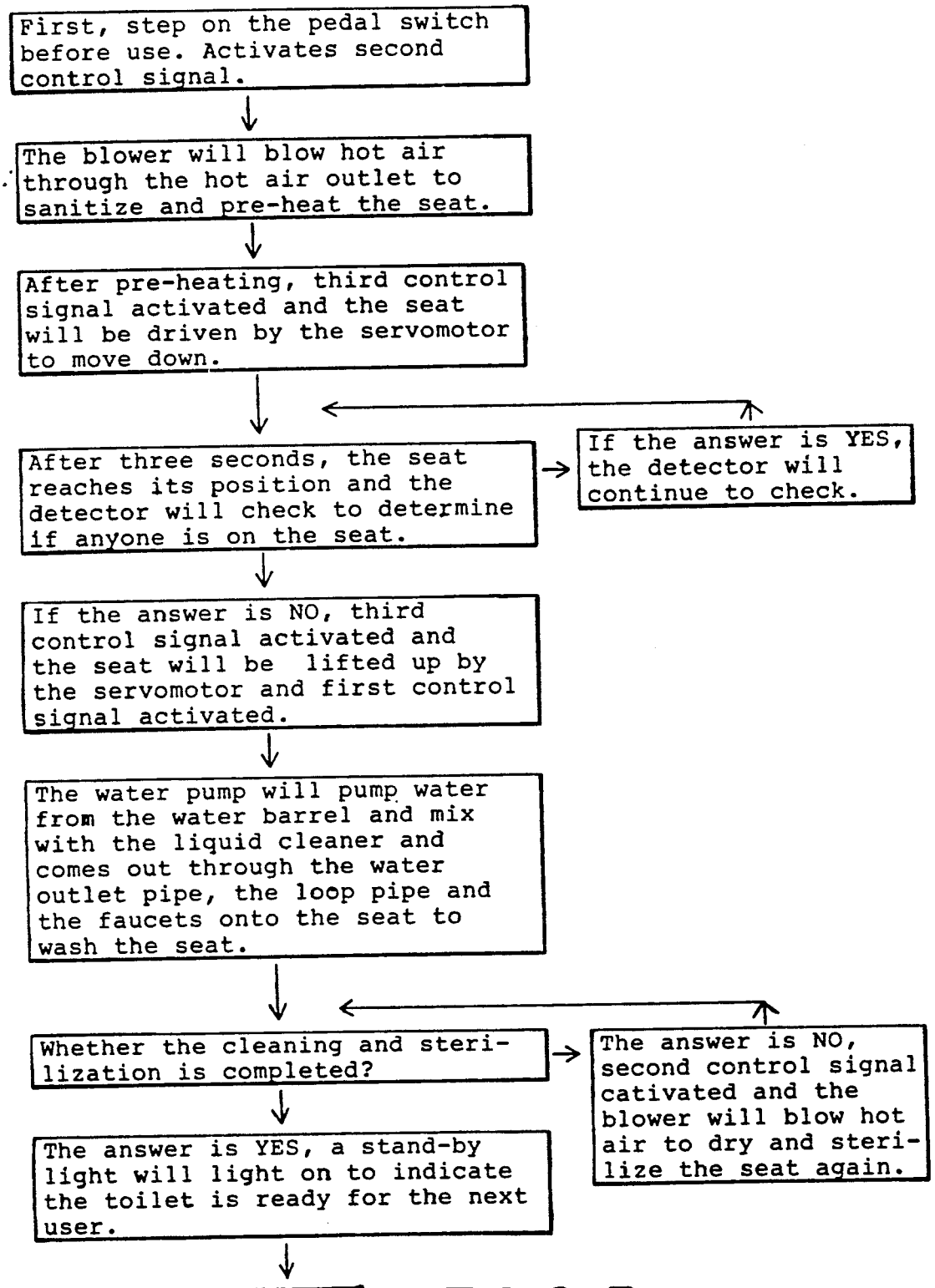
FIG. 5 is a flow chart of the present invention.

A blower 6 has a motor 61 to drive a blade 62 for blowing air out through an electric heater 63, which changes the air from cool to hot. The hot air flows through a loop pipe 64 to the outlet holes 641. The servomotor 7 has a gear 71 at one end which is engaged with the gear 221 at the end of axle 22, to drive the seat 2 up or down (shown in FIGS. 3 and 6). The seat 2 being raised to a position adjacent the cover 1 for the cleaning and heating operations, as shown in the flow diagram of FIG. 5. operations, as shown in the flow diagram of FIG. 5.

Figure 4:
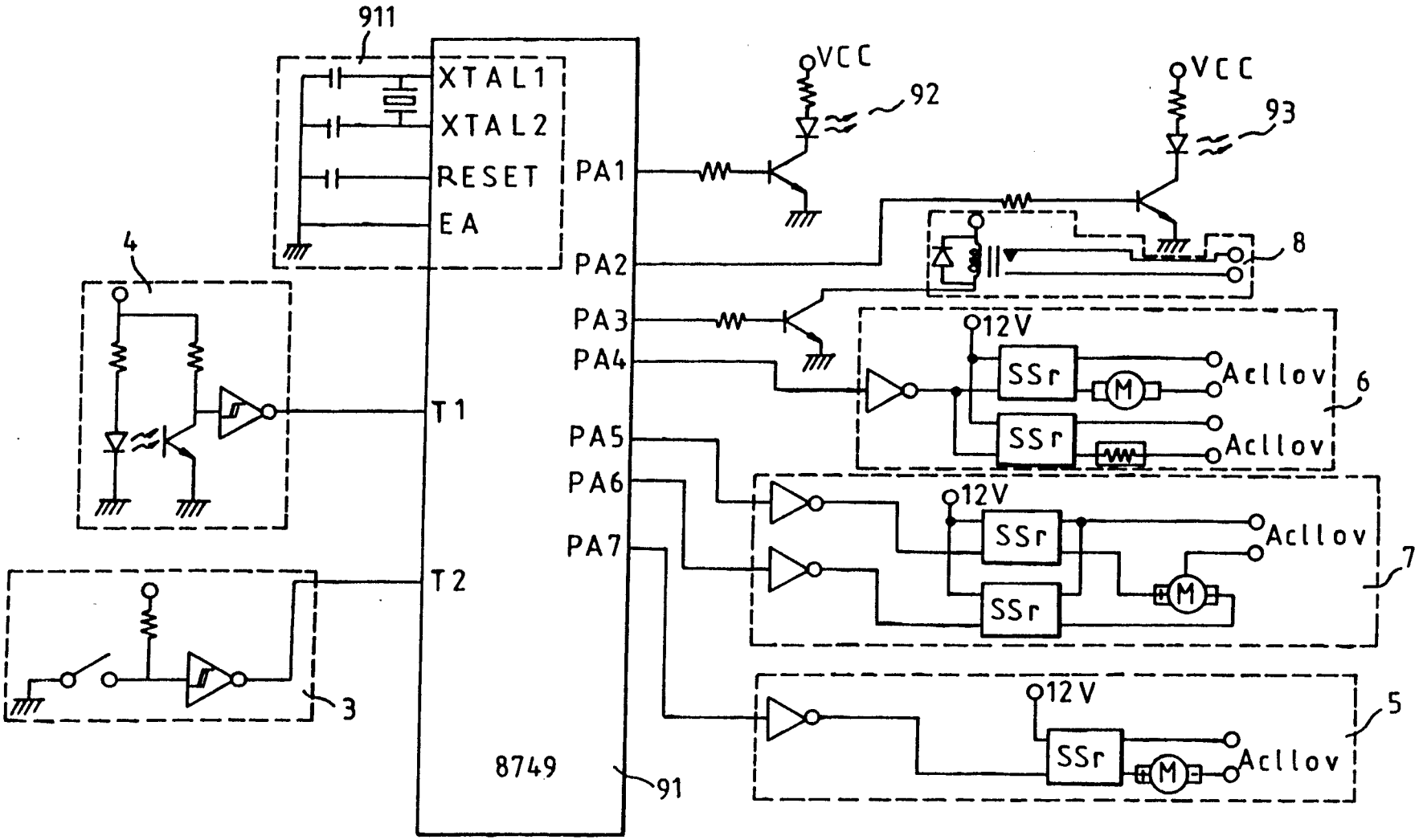
FIG. 4 is a circuit diagram of the present invention.

Referring additionally to FIG. 4, the auto-flusher 8 is a relay coupled to an output of microprocessor 91. The circuit box 9 includes microprocessor 91 and a timer 911. Each block shown controls one subassembly. The block 3 represents the pedal switch 3, the block 4 is the detector 4, the block 5 is the circuit for the water pump 5, the block 6 is the circuit for the blower 6, the block 7 is the circuit for the servomotor 7 and the block 8 is the circuit for the auto-flusher 8.

I claim:

1. A toilet sanitizing device comprising:

cover means coupled to a toilet fixture for cleaning and heating a toilet seat, said toilet seat being pivotally coupled to said toilet fixture, said toilet fixture having a water supply tank, said cover means including:

a. a plurality of liquid outlet nozzles;

b. a first distribution pipe coupled to each of said plurality of nozzles for supplying a cleaning solution thereto;

c. fluid cleaning means coupled to said first distribution pipe for supplying said cleaning solution responsive to a first control signal, said fluid cleaning means includes a water pump having an inlet fluidly coupled to a water inlet pipe and an outlet fluidly coupled to an outlet pipe, said outlet pipe being fluidly coupled to said first distribution pipe, and a cleaning solution reservoir fluidly coupled to said outlet pipe for mixing a cleaning liquid stored in said reservoir with water output by said water pump;

d. a plurality of heated air outlets disposed adjacent said plurality of nozzles;

e. a second distribution pipe coupled to each of said plurality of heated air outlets for supplying heated air thereto; and, f. blower means for providing said heated air to said second distribution pipe responsive to a second control signal, said blower means including a heater element for heating air passing from an inlet to said second distribution pipe, said second control signal actuating said blower means for preheating said toilet seat and driving said toilet seat subsequent to a fluid cleaning of said toilet seat;

a water reservoir disposed within said water supply tank for supply a predetermined quantity of water to said water pump, said water reservoir having a perimeter wall of a predetermined height dimension less than a full storage water level of said water supply tank, said perimeter wall having an open upper end for receiving water from said water supply tank;

a servomotor drivingly coupled to said toilet seat for reversibly rotatively displacing said toilet seat from a first position to a second position responsive to a third control signal, said second position being adjacent said cover means to effect cleaning of said toilet seat;

microprocessor means coupled to said cover means for generating said first and second control signals to control said water pump and said blower means respectively, and said servomotor for displacing said toilet seat responsive to said third control signal wherein said microprocessor means generates said second control signal to preheat said toilet seat followed by generation of said third control signal to displace said toilet seat from said second position to said first position responsive to operation of a pedal switch; and, means for detecting whether said toilet seat is occupied, coupled to said microprocessor means, said microprocessor means generating said third control signal for displacing said toilet seat from said first position to said second position followed by generation of said first control signal for dispensing said cleaning liquid mixed with said water and subsequently followed by generation of said second control signal for drying said toilet seat.

2. The toilet sanitizing device as recited in claim 1 where said detecting means includes an infrared detector secured to said cover means, said infrared detector being electrically coupled to said microprocessor means.

* * * * *